United States Patent [19]

Hurwitz

[11] Patent Number: 4,494,520

[45] Date of Patent: Jan. 22, 1985

[54] SHEATHING SYSTEM FOR AUTOMOTIVE OR MARINE IGNITION WIRES

[75] Inventor: Scott L. Hurwitz, Fairport, N.Y.

[73] Assignee: Magnum Shielding Corp., Pittsford, N.Y.

[21] Appl. No.: 459,054

[22] Filed: Jan. 19, 1983

[51] Int. Cl.[3] ..... F02P 15/00; H01R 4/64

[52] U.S. Cl. ..... 123/633; 174/35 SM; 174/72 A; 339/14 R

[58] Field of Search ..... 174/35 SM, 40 CC, 70 R, 174/72 A, 78, 82; 339/14 R, 14 L, 143 R, 143 S, 148; 123/143 C, 169 P, 169 PA, 169 PH, 594, 633, 647

[56] References Cited

U.S. PATENT DOCUMENTS

| | | | |
|---|---|---|---|
| 1,619,991 | 3/1927 | Smarr | 123/143 C |
| 1,786,585 | 12/1930 | Walker | 174/82 X |
| 2,149,027 | 2/1939 | Meredith | 174/35 SM X |
| 2,414,575 | 1/1947 | Windsor | 174/59 X |
| 2,441,321 | 5/1948 | Ingalls | 174/35 SM X |
| 2,551,299 | 5/1951 | Sowa | 174/84 C X |
| 2,650,948 | 9/1953 | Findlay | 174/168 |
| 2,997,531 | 8/1961 | Oldham et al. | 174/158 R |
| 3,010,183 | 11/1961 | Forney, Jr. | 174/84 C X |
| 3,080,140 | 3/1963 | Gohs et al. | 248/74 R |
| 3,128,139 | 4/1964 | Estes | 339/26 |
| 3,292,605 | 12/1966 | Livingston | 174/35 SM X |
| 3,828,298 | 8/1974 | Schumacher | 174/75 C X |

FOREIGN PATENT DOCUMENTS

| | | | |
|---|---|---|---|
| 1244946 | 9/1960 | France | 174/40 CC |

OTHER PUBLICATIONS

IBM Technical Disclosure Bulletin–vol. 20, #10, 3/78, Uberacher,—"Optical Fiber Ribbon Cable".

*Primary Examiner*—Laramie E. Askin

*Attorney, Agent, or Firm*—Stonebraker, Shepard & Stephens

[57] ABSTRACT

Automotive or marine ignition wires have braided metallic sheaths extending along their lengths and terminating at an electrically insulating distance from end regions of the wires. A metal bar strip bearing metal spring clips sized for resiliently gripping the sheaths has the clips uniformly spaced from each other along the length of the bar. A ground wire secures the bar to ground for electrically grounding the bar strip, the spring clips, and sheaths. Sleeve ferrules encircle and secure the ends of the sheathing to each wire so that the sheathing cannot move axially of the wires.

6 Claims, 3 Drawing Figures

SHEATHING SYSTEM FOR AUTOMOTIVE OR MARINE IGNITION WIRES

BACKGROUND

Automotive ignition wire sheathing systems that were popular in the 1950's and 1960's became so costly that they are no longer sold. Nevertheless, braided metal sheaths over ignition wires offer several advantages. They protect the wires from damage, double their heat resistance, and greatly improve their appearance; and grounded metal sheaths ensure suppression of electrical activity and elimination of radio and instrument interference.

I have discovered a simpler and less expensive way of applying and grounding braided metallic sheaths for automotive or marine ignition wires to accomplish these advantages at a lower cost. My system uses some components that are available for other purposes and accomplishes sheathing, wire organization and spacing, and electrical grounding, all with simple and inexpensive parts that the user can easily assemble and install.

SUMMARY OF THE INVENTION

My ignition wire sheathing system uses shiny braided metallic sheaths covering a set of ignition wires so that the sheaths extend along the length of each ignition wire and terminate at an electrically insulating distance from end regions of each wire. A metal bar strip bears several metal spring clips uniformly spaced along the length of the bar and sized for resiliently gripping the sheaths on the ignition wires. A ground wire secured to the bar strip is connectable to a ground for electrically grounding the bar strip, spring clips, and sheaths. Such an arrangement also organizes and separates the ignition wires and eliminates any need for complex electrical grounding at end regions of the wires. This is especially convenient if one of the ignition wires must be disconnected or changed.

DRAWINGS

DETAILED DESCRIPTION

Figure 1:
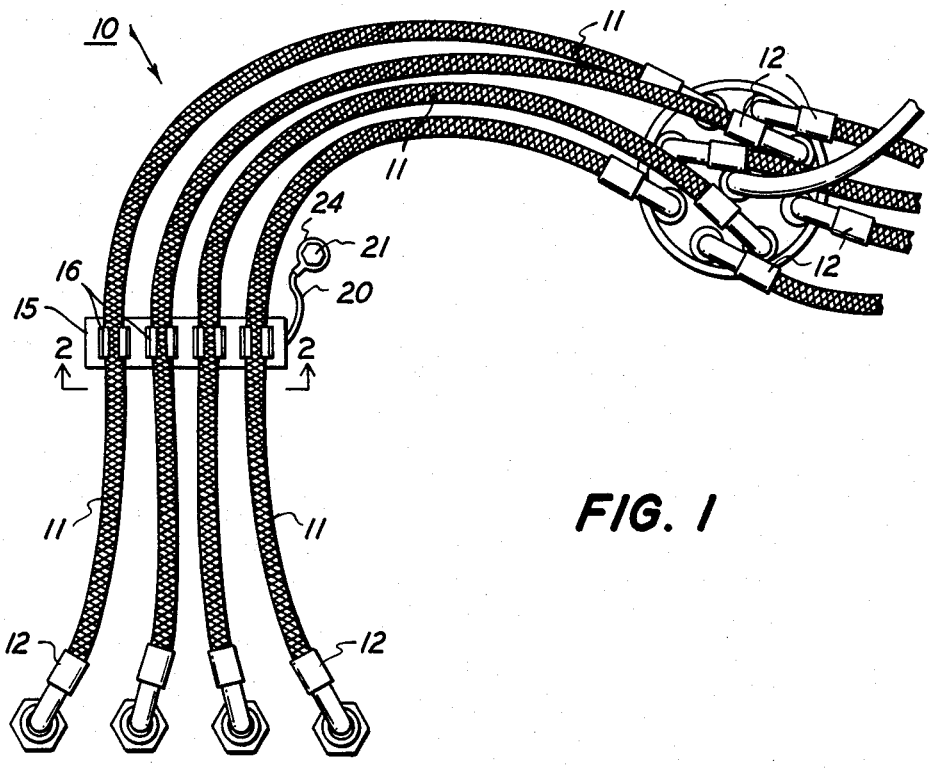
FIG. 1 is a perspective view of one-half of an ignition wire system that is sheathed, organized, and grounded according to my invention.
Figure 2:
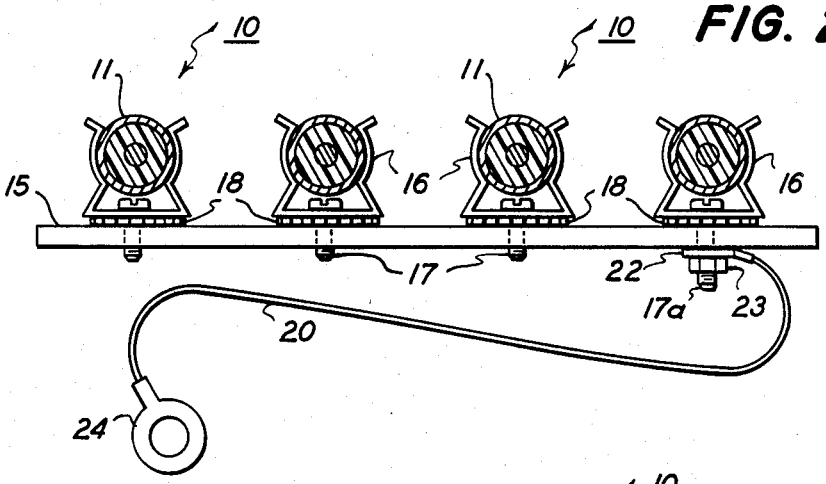
FIG. 2 is a cross-sectional view of the sheathed ignition wire grounding system of FIG. 1 taken along the line 2—2 thereof.
Figure 3:
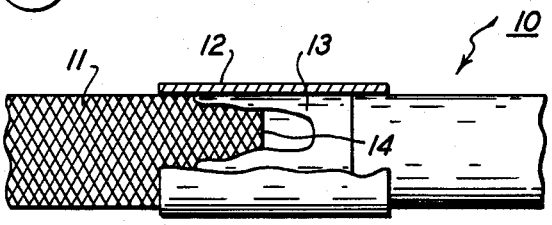
FIG. 3 is an enlarged and partially cut-away view of a sleeve ferrule holding a braided metallic sheath in position on an ignition wire.

My system uses generally known ignition wires 10 terminated at one end for spark plugs and at another end for a distributor cap. Before terminating wires 10, however, I sheathe them with shiny braided metallic sheaths 11. Instead of extending sheaths 11 all the way to the terminations for a spark plug or a distributor cap, I terminate sheaths 11 at an electrically insulating distance from end regions of each ignition wire 10. This eliminates complex and expensive grounding of the sheaths at the spark plug or distributor cap terminations, and it keeps sheaths 11 spaced from and electrically insulated from end terminations of wires 10.

Sheaths 11 must not slide axially along wires 10 or they could move close enough to one of the terminations to short out the wires. I prefer a simple sleeve ferrule 12 for holding sheaths 11 in axial position on wires 10, and I also prefer a wrapping of tape 13 over the ends 14 of sheaths 11. I wrap a turn of tape 13 over sheath ends 14 to straddle sheathing 11 and wire 10, then I slide sleeve ferrule 12 over tape 13 to conceal tape 13 and overlap sheathing 11 and hold sheathing 11 securely in place on wire 10. I select sleeve 12 with an inside diameter only slightly larger than sheathing 11 so that it will just slide over tape 13 and sheathing 11 and complete the anchorage of sheathing 11 when squeezed down to a slightly smaller diameter. This allows sleeve 12 to anchor sheathing 11 securely on wire 10 without being crimped or dented into an irregular, non-cylindrical shape. I also select sleeve 12 of stainless steel, anodized aluminum, or plated metal so that it retains a gleaming metallic appearance and preserves the good looks of the sheathed wires.

Sheaths 11 on wires 10 must be grounded, and wires 10 benefit from being organized and spaced from each other. I accomplish both with a simple bar strip and clip arrangement.

I provide the customer with a pair of metal bar strips 15 and four metal spring clips 16 for each bar 15 for an eight-wire ignition set. Of course, the invention can be applied to automotive or marine engines having different numbers of ignition wires, simply by using the appropriate numbers of bar strips and clips. Bar 15 has uniformly spaced holes bored and tapped along its length, and screws 17 turned into the tapped holes in bar 15 secure spring clips 16 in place. Lock washers 18 positioned between bar 15 and spring clips 16 help keep clip 16 aligned transversely of bar 15 as illustrated and keep screws 17 from vibrating loose.

Spring clips 16 and bars 15 are available for holding electrical fuses, and these parts can be purchased in suitable sizes and spacing. Each spring clip 16 resiliently engages sheathing 11 on an ignition wire 10, and spring clips 16 are uniformly spaced along the length of bar 15 as illustrated. Bars 15 and spring clips 16 are also made of metal formed to maintain a shiny appearance. Spring clips 16 not only space and organize wires 10, but provide an electrically connecting path common to all sheaths 11.

I also provide the customer with a ground wire 20 that connects to bar strip 15 and to any convenient ground such as a valve cover bolt 21. I prefer that ground wire 20 be made of preformed stainless steel strands and have terminations on each end suitably sized for grounding.

To connect ground wire 20 to bar 15, I prefer that one of the screws 17*a* be longer than the others and have a length extending through bar 15 to receive an end terminal 22 connected to wire 20 and held in place with a lock nut 23 on screw 17*a*. A larger end terminal 24 on the other end of the ground wire 20 can be connected to valve cover bolt 21 or some other convenient ground. Wire 20 need not be electrically insulated because it is a ground wire, and forming it of stainless steel ensures that it can maintain a shiny appearance throughout its life.

Bar strip 15 can be positioned wherever convenient between the distributor and spark plug ends of wires 10 and users will place bars 15 in different positions for different engines. For wire organizing purposes, bar 15 is generally transverse to wires 10, and spring clips 16 are transverse to bar 15 and parallel with wires 10 where spring clips 16 grip sheaths 11.

My sheathing system is all formed of shiny metal for lasting good looks and gets all the benefits of metal sheathing 11 for wires 10 along with a simple and economical organizing and grounding arrangement. My system is easy and convenient for the user to assemble and install and is versatile enough to accommodate most engines without requiring any different components for each engine. It thus accomplishes the advantages available from metallically sheathed ignition wires without the cost and expense of previous arrangements for terminating and grounding the sheaths. While accomplishing these advantages, it also organizes and supports the wires with a neat and attractive bar and spring clip arrangement.

I claim:

1. A system of organizing and grounding a set of ignition wires covered with braided metallic sheaths terminating at an electrically insulating distance from terminal end regions of said wires, which when installed on an engine are spread apart from each other to attach to spark plugs at one terminal end region and to an electrical input at another terminal end region, said system comprising:

a. an organizer strip formed of electrically conductive material;

b. said organizer strip extending longitudinally far enough to span a transverse distance across a plurality of said wires;

c. means for securing said plurality of sheathed ignition wires in parallel positions on said strip so that said organizer strip forms an electrical common between said sheaths of the secured ignition wires;

d. said organizer strip being secured to mid-regions of said sheaths in a location that can vary between ends of said sheaths;

e. said organizer strip having no fixed connection other than to said sheaths so that said organizer strip is movable with said sheathed ignition wires throughout a limited range of movement;

f. a flexible ground wire having an end termination connectable to ground; and g. said flexible wire being arranged for providing an electrical path from said electrical common to ground.

2. The system of claim 1 including radially compressed ferrules overlying and concealing ends of said sheaths.

3. The system of claim 2 including a wrapper of a thin flat adhesive tape arranged over each of said sheath ends underneath said ferrules.

4. The system of c1aim 1 wherein said means for securing includes resilient means for gripping said sheaths of each of said secured ignition wires.

5. The system of claim 4 including radially compressed ferrules overlying and concealing ends of said sheaths.

6. The system of claim 5 including a wrapper of a thin flat adhesive tape arranged over each of said sheath ends underneath said ferrules.

* * * * *